United States Patent [19]

Mars

[11] Patent Number: 5,058,279

[45] Date of Patent: Oct. 22, 1991

[54] WEDGED HANDLE EATING UTENSIL FOR THE PHYSICALLY DISABLED

[76] Inventor: Suzanne P. Mars, 23649 Duffield Rd., Shaker Hts., Ohio 44122

[21] Appl. No.: 510,127

[22] Filed: Apr. 17, 1990

[51] Int. Cl.[5] ..... A47J 43/00; A47J 43/28

[52] U.S. Cl. ..... 30/327; 30/324; 30/323

[58] Field of Search ..... 30/323, 324, 329, 296, 30/290, 273, 263, 198, 109

[56] References Cited

U.S. PATENT DOCUMENTS

| | | | |
|---|---|---|---|
| 222,549 | 12/1879 | Trueblood | 30/327 |
| 1,095,469 | 5/1914 | Rice | 30/327 |
| 1,273,642 | 7/1918 | Margetts | 30/327 |
| 1,347,307 | 7/1920 | Thomas | 30/327 |
| 2,647,310 | 8/1953 | Yolles | 30/32 X |
| 2,725,631 | 12/1955 | Renke | 30/322 |
| 2,853,780 | 9/1958 | Bull | 30/327 |
| 4,218,167 | 8/1980 | Mansfield | 30/327 |

*Primary Examiner*—Douglas D. Watts
*Assistant Examiner*—Paul M. Heyrana, Sr.
*Attorney, Agent, or Firm*—Weston Hurd Fallon Paisley & Howley

[57] ABSTRACT

The present invention is an eating utensil set for the physically disabled. The invention comprises a handle, a shaft and an eating utensil head. The handle is in the shape of a multi-sided geometric solid five surfaces: a flat bottom surface adapted to rest upon a horizontal surface such as an eating table, a back surface; a first side surface; a second side surface; and a front surface, preferably curved. The upper portion of the back surface serves as the point of attachment for the shaft. The shaft terminates in the eating utensil head. In addition, the utensil head may be modified to increase the surface area available for the food and to increase the stability of the food on the eating utensil. The new and improved eating utensil is capable of being used by individuals having a variety of disabilities, particularly those individuals with limited wrist movement.

12 Claims, 1 Drawing Sheet

WEDGED HANDLE EATING UTENSIL FOR THE PHYSICALLY DISABLED

BACKGROUND OF THE INVENTION

1. Field of the Invention

The invention relates to eating utensils which enable people with hand and wrist disabilities, particularly limited range of motion in the wrist, to feed themselves.

2. Description of the Prior Art

Physical disabilities of the hands and wrists make it particularly difficult for people to carry out simple functions of everyday life. In particular, feeding oneself with ordinary eating utensils presents a burdensome task to such individuals, particularly individuals whose wrist movement is limited due to conditions such as arthritis. For conventional eating utensils the non-disabled individual must possess a certain degree of fine motor skills in order to pick up and hold the utensils. In addition, a non-disabled individual using conventional eating utensils must use a variety of different manipulations involving multiple muscles of the hands and arms, and involving multiple joints in the fingers, hands, wrists and elbows. Manipulations require a high degree of coordinated movement in order to successfully feed oneself without dropping or spilling the food. However, for people possessing disabilities, more particularly joint disabilities such as limited wrist movement, picking up and using the eating utensils is painful and requires a tremendous amount of time to execute a simple motion. By "conventional eating utensils", we are referring to forks, knives and spoons, known in the prior art which possess thin, small handles about one-half inch to one inch wide.

While modifications have been made to enlarge the handles of conventional eating utensils to provide an easier grip, this does not eliminate the wrist rotation required to feed oneself with these utensils. Desirably, eating utensils would be available that would avoid the drawbacks of conventional eating utensils and be capable of use without wrist movement.

SUMMARY OF THE INVENTION

The present invention overcomes the foregoing drawbacks in the prior art and provides a new and improved eating utensil comprising: a handle, a shaft and an eating utensil head. The handle comprises a geometric solid having five surfaces: a flat bottom surface adapted to rest upon a horizontal surface such as the eating table, a back surface; a first side surface; a second side surface and a front surface, preferably curved. The upper portion of the back surface serves as the point of attachment for the shaft. The shaft terminates in the head of the eating utensil. The new and improved eating utensil is capable of being used by individuals having a variety of disabilities, particularly those individuals with limited wrist movement.

DESCRIPTION OF THE PREFERRED EMBODIMENT

Figure 3:
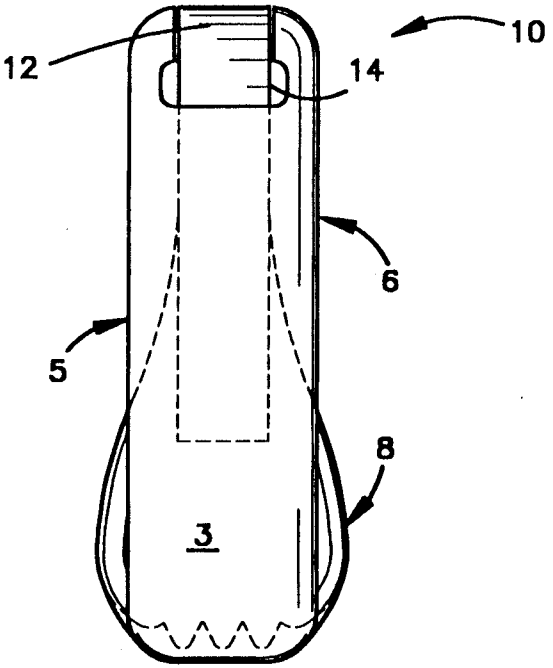
FIG. 3 is a top plan view of the eating utensil of FIG. 1.
Figure 1:
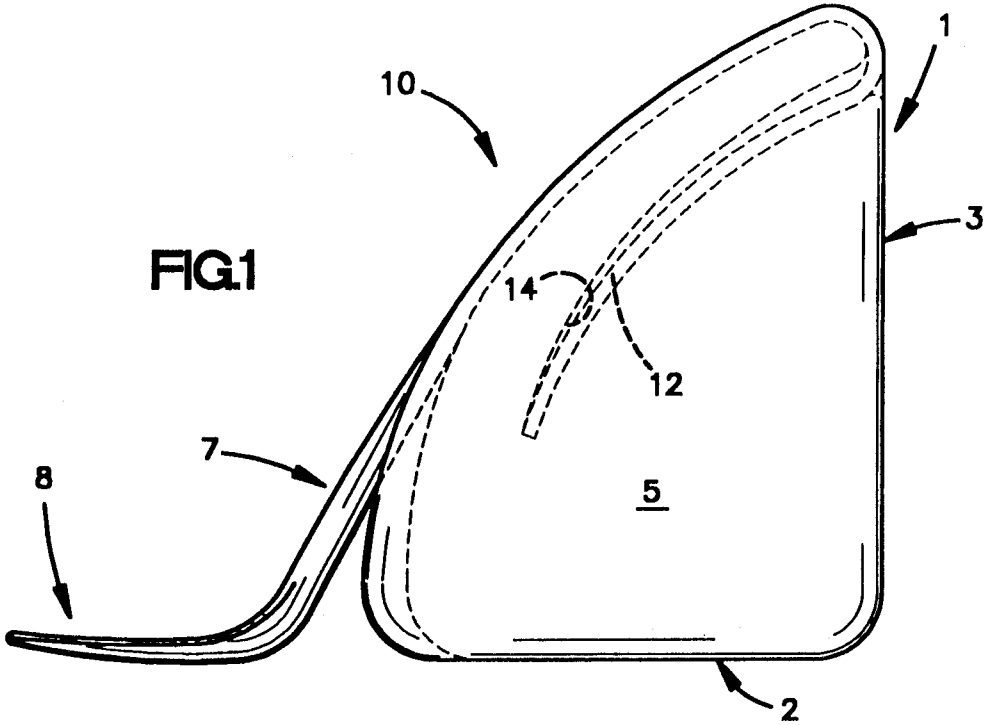
FIG. 1 is a side elevational view of an eating utensil according to the invention.
Figure 2:
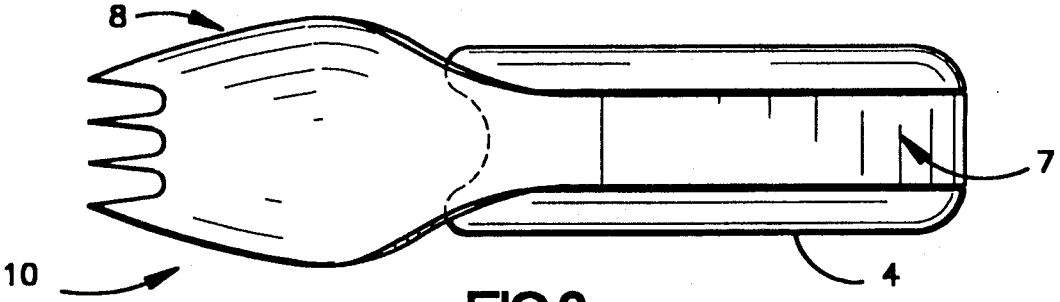
FIG. 2 is a rear elevational view of the eating utensil of FIG. 1.

Referring to FIGS. 1, 2, and 3 the eating utensil 10 comprises a handle 1, a shaft 7 and an eating utensil head 8.

The Handle

The handle 1 functions as both a means for grasping the utensil 10 and as a base or support means. The handle 1 is symmetrical about the vertical axis of the eating utensil 10. Due to the symmetry, it may be used in either the left hand or the right hand. The size and shape of the handle 1 permit disabled individuals to grasp the utensil 10 more easily than ordinary eating utensil handles. In addition, due to the flat bottom surface 2 of the handle 1, the eating utensil 10 may sit upright on a table in a position that is easily accessible. Thus the number of movements and the type of movements needed to pick up the eating utensil 10 are reduced. The width of the handle 1 may range from about ½ inch to about 2 inches, preferably about 5/16 inch. The depth of the handle may range from about 1½ inches to about 4 inches, preferably about 2 12/16 inches. The height of the handle 1 may vary from about 2 inches to about 4½ inches, preferably 3 7/16 inches. The handle 1 is comprised of five surfaces: a bottom surface 2, a first side surface 5, a second side surface 6, a back surface 3 and a front surface 4. When references herein are made to left or right, it will be from the perspective of facing the back surface 3. The bottom surface 2 is adapted to rest on a flat horizontal surface, such as an eating table. The depth or length of the bottom surface 2 defines the depth of the handle 1. The left side edge of the bottom surface 2 is contiguous with the bottom edge of the first side surface 5. Similarly the right edge of the bottom surface 2 is contiguous with the bottom edge of the second side surface 6. The back edge of the bottom surface 2 is contiguous with the bottom edge of the back surface 3. Preferably the point where the back edge of the bottom surface 2 meets the bottom edge of the back surface 3 may be shaped in a gentle curve. The front edge of the bottom surface 2 is contiguous with the bottom edge of the front surface 4.

The first side surface 5 is perpendicular to the bottom surface 2 and the back surface 3. The back edge of the first side surface 5 is contiguous with the left side edge of the back surface 3. The second side surface 6 is parallel to the first side surface 5. The two sides 5, 6 are spaced a distance approximately equal to the distance between a user's thumb and fingers when the user's thumb and fingers are parallel to each other.

The front surface 4 of the handle 1 is formed by a smooth curve extending from the front edge of the bottom surface 2 to the top edge of the back surface 3. A receptacle 14 extends into the handle 1 from a location in the vicinity of the upper portion of the back surface 3. The left edge of the front surface 4 defines the third edge of the first side surface 5. The right edge of the front surface 4 defines the third edge of the second side surface 6. Alternatively, the handle 1 could be formed with a front surface 4 perpendicular to the bottom surface 2 and a top surface 9 parallel to the bottom surface 2. However, for aesthetic reasons a smooth curved surface is shown in the drawings. The handle 1 could also be designed so that there is a hole or void in the center of the handle 1. This hole would be located on the first side surface 5 and extend through the second side surface 6.

Although the handle may be grasped in a variety of ways to accommodate the comfort of the individual user, it is contemplated that for a solid handle 1, one side surface 5 or 6 rests in the user's palm. The person's fingers bend around the back surface 3 and continue around so that the ends of the person's fingers rest on the opposite side surface with the fingertips pointing toward the person. The thumb would rest along the top of the front surface 4 anywhere that is comfortable for the user.

The Shaft

As shown in FIGS. 1 and 2, the shaft 7 of the eating utensil 10 has a tang 12 which is retained by the receptacle 14. The tang 12 is bent back upon itself so as to be generally parallel with the shaft 7. The front surface 4 of the handle 1 and the receptacle 14 diverge so that the tang 12 is urged away from the shaft 7 when the tang 12 is inserted into the receptacle 14 in an interference fit. The tang 12 projects out of the top of the back surface 3 extends upward over the top of the handle 1 and follows the contour of the curve of the front surface 4 in surface-to-surface contact with the front surface 4 downward to a point above the head 8 of the eating utensil 10. The curve of the shaft 7 diverges from the contour of the front surface 4 approximately where the shaft 7 terminates in the head 8 of the eating utensil 10. The width of the shaft 7 may be any width that permits the shaft 7 to be attached to the handle 1. For aesthetic considerations, it may be preferred that the width of the shaft 7 is less than the width of the front surface 4.

The Eating Utensil Head

As used herein, the eating utensil head 8 is the part of the eating utensil 10 which is adapted to collect and hold the food, and which comes in contact with the mouth. The eating utensil head 8 may be a conventional forkhead or a conventional spoon or, preferably, a combination of a forkhead and spoonhead, known as a "spork", which is shown in FIG. 2. The head of the spork may be equipped with one or more tines which enable the eating utensil 10 to have the spearing action of a conventional fork. However, the area behind the tines between the back of the tines and the shaft 7 is enlarged to provide a greater surface area for holding food. In addition, this area between the back of the tines and the shaft 7 may be depressed to give a bowl effect which aids in keeping the food on the fork. In addition the back sides of the head of the spork may be raised to keep food from falling off.

While one embodiment of the invention has been shown and described, various adaptations and modifications could be made without departing from the scope of the invention as defined in the appended claims. The dimensions may be enlarged to accommodate a larger hand, or reduced to accommodate the size of a child's hand.

What is claimed is:

1. An eating utensil for use by persons with limited wrist movement, comprising:

a handle, the handle including a base adapted to rest upon a horizontal surface, the base having a front edge, a back edge, and opposed side edge, the handle being in the shape of a geometric solid, the handle including a back surface, opposed side surfaces, and a front surface, the handle having a vertical dimension when the base is resting on the horizontal surface adequate to permit the handle to be grasped by the fingers of a user's hand;

a shaft connected to the handle, the shaft projecting from the front surface of the handle at a location in the vicinity of the base; and a utensil head connected to the shaft, the utensil head projecting laterally from the shaft to lie in a generally horizontal plane when the base is resting on the horizontal surface.

2. The eating utensil of claim 1, further comprising:

a tang projecting from the end of the shaft opposite the utensil head; and a receptacle included as part of the handle into which the tang is inserted and retained.

3. The eating utensil of claim 2, wherein the tang is secured within the receptacle by means of an interference fit.

4. The eating utensil of claim 1, wherein the front surface is curved outwardly from the front edge of the base to the upper portion of the back surface.

5. The eating utensil of claim 4, wherein the shaft is in substantial surface-to-surface contact with the front surface.

6. The eating utensil of claim 5, further comprising:

a tang projecting from the end of the shaft opposite the utensil head, the tang being bent back upon itself so as to be generally parallel with the shaft; and a receptacle included as part of the handle into which the tang is inserted and retained, the receptacle extending into the handle from a location in the vicinity of the upper portion of the back surface.

7. The eating utensil of claim 6, wherein the front surface and the receptacle diverge so that the tang is urged away from the shaft when the tang is inserted into the receptacle.

8. The eating utensil of claim 1, wherein the opposed sides of the handle are parallel and are spaced a distance approximately equal to the distance between a user's thumb and fingers when the user's thumb and fingers are parallel to each other.

9. The eating utensil of claim 1, wherein the utensil head is in the shape of a conventional fork.

10. The eating utensil of claim 1, wherein the utensil head is in the shape of a spork.

11. The eating utensil of claim 1, wherein the utensil head is in the shape of a spoon.

12. An eating utensil for use by persons with limited wrist movement, comprising:

a handle, the handle including a base adapted to rest upon a horizontal surface, the base having a front edge, a back edge, and opposed side edges, the handle being in the shape of a geometric solid, the handle including a back surface, opposed side surfaces, and a front surface, the front surface being curved outwardly from the front edge of the base to the upper portion of the back surface, the opposite sides of the handle being parallel and spaced a distance approximately equal to the distance between a user's thumb and fingers when the user's thumb and fingers are parallel to each other, the handle having a vertical dimension when the base is resting on the horizontal surface adequate to permit the handle to be grasped by the fingers of a user's hand;

a shaft connected to the handle, the shaft projecting from the front surface of the handle at a location in the vicinity of the base, the shaft being in substantial surface-to-surface contact with the front surface;

a tang projecting from the end of the shaft opposite the utensil head, the tang being bent back upon itself so as to be generally parallel with the shaft;

a utensil head connected to the shaft, the utensil head projecting laterally from the shaft to lie in a generally horizontal plane when the base is resting on the horizontal surface;

a receptacle included as part of the handle into which the tang is inserted and retained, the receptacle extending into the handle from a location in the vicinity of the upper portion of the back surface; and wherein the front surface and the receptacle diverge so that the tang is urged away from the shaft when the tang is inserted into the receptacle.

* * * * *